US006108951A

United States Patent [19]

Renfrow et al.

[11] Patent Number: 6,108,951

[45] Date of Patent: Aug. 29, 2000

[54] WORK MACHINE HAVING IMPROVED IMPLEMENT COUPLING ARRANGEMENT

[75] Inventors: Jay H. Renfrow, Clayton; John P. Hall, Wilson, both of N.C.; Michael R. Helgeson, Peoria, Ill.

[73] Assignee: Caterpillar Inc., Peoria, Ill.

[21] Appl. No.: 09/116,390

[22] Filed: Jul. 16, 1998

[51] Int. Cl.[7] ..... E02F 3/96

[52] U.S. Cl. ..... 37/468; 37/403; 414/723; 414/912

[58] Field of Search ..... 37/468, 403, 409, 37/410; 414/723, 912

[56] References Cited

U.S. PATENT DOCUMENTS

| | | | |
|---|---|---|---|
| 4,643,631 | 2/1987 | Maurer et al. | 414/723 |
| 4,890,974 | 1/1990 | Kistner | 414/723 |
| 4,974,349 | 12/1990 | Timmons | 37/403 |
| 4,986,722 | 1/1991 | Kaczmarczyk et al. | 414/723 |
| 5,024,010 | 6/1991 | Hulden | 414/723 |
| 5,115,583 | 5/1992 | Vail | 37/403 |
| 5,224,816 | 7/1993 | Kaczmarczyk et al. | 414/723 |
| 5,423,137 | 6/1995 | Cochran | 37/403 |
| 5,431,528 | 7/1995 | Jenkins et al. | 414/723 |
| 5,634,736 | 6/1997 | Brown et al. | 414/723 |
| 5,890,871 | 4/1999 | Woerman | 414/723 |

FOREIGN PATENT DOCUMENTS

0508692A1 10/1992 European Pat. Off. .

*Primary Examiner*—Thomas B. Will
*Assistant Examiner*—Kristine M. Markovich

[57] ABSTRACT

A work machine having a stick assembly which- includes (i) a stick having a forward stick aperture (ii) a guide which is pivotally coupled to the stick, and (iii) a link pivotally coupled to the guide is disclosed. The work machine also includes a coupler having a left lateral support and a right lateral support, wherein (i) the left lateral support has a left rear coupler aperture, a left intermediate coupler aperture, and a left forward coupler notch, and (ii) the right lateral support has a right rear coupler aperture, a right intermediate coupler aperture, and a right forward coupler notch. The work machine also includes an implement assembly having a left bracket and a right bracket, wherein (i) the left bracket has a left rear implement aperture, a left intermediate implement aperture, and a left forward implement aperture, and (ii) the right bracket has a right rear implement aperture, a right intermediate implement aperture, and a right forward implement aperture, and wherein the left intermediate coupler aperture, the right intermediate coupler aperture, the left intermediate implement aperture, and the right intermediate implement aperture are linearly aligned when (i) the left rear coupler aperture, the right rear coupler aperture, the forward stick aperture are linearly aligned with the left rear implement aperture and the right rear implement aperture, and (ii) the left forward coupler notch, the right forward coupler notch are linearly aligned with the left forward implement aperture and the right forward implement aperture.

19 Claims, 4 Drawing Sheets

WORK MACHINE HAVING IMPROVED IMPLEMENT COUPLING ARRANGEMENT

TECHNICAL FIELD OF THE INVENTION

The present invention relates generally to a work machine having an implement assembly attached thereto, and more particularly to an apparatus for attaching an implement assembly to a stick of a work machine.

BACKGROUND OF THE INVENTION

Work machines, such as backhoes, typically include an implement assembly attached to a stick assembly. Backhoes are typically utilized for various work functions. For example, a backhoe may be used to move large amounts of gravel for a period of time, and then used to dig a hole or a ditch. When the work function of the backhoe is altered as described above, it may be necessary to change the implement assembly in order for the work function to be performed properly. For example, one type of implement assembly may be attached to the stick assembly for scooping and moving gravel, and another type of implement assembly attached to the stick assembly for digging a ditch. Detaching one implement assembly from the stick assembly and attaching another is a problem because of the time and labor expended in the changeover.

One approach to addressing the above described problem is to attach a coupler to the backhoe stick assembly and then attach the implement assembly to the coupler. The coupler facilitates the coupling and decoupling between the stick assembly and the implement assembly, and thus decreases the amount of time and labor expended changing from one implement assembly to another.

However, the design of many couplers and stick assemblies cause serious performance problems for implement assemblies. For example, some couplers limit the degree of rotation of the implement assembly relative to the stick assembly as compared to when no coupler is used. Therefore, for certain work functions (e.g. those work functions requiring a greater degree of rotation of the bucket relative to the stick assembly), having a coupler attached to the stick assembly interferes with the performance of the work function. In addition, the use of some couplers results in the implement assembly being rotated relative to the stick with less force. Rotating the implement assembly with less force can also cause problems when performing certain work functions.

What is needed therefore is a work machine which overcomes the above-mentioned performance problem.

DISCLOSURE OF THE INVENTION

In accordance with a first embodiment of the present invention, there is provided a work machine which includes a support member having a forward support aperture. The work machine also includes a coupler having a left lateral support and a right lateral support, wherein (i) the left lateral support has a left rear coupler aperture defined therein, and (ii) the right lateral support has a right rear coupler aperture defined therein. The work machine also includes a link pivotally coupled to the coupler, the link having a forward link aperture. The work machine further includes an implement assembly having a left bracket and a right bracket, wherein (i) the left bracket has a left rear implement aperture and a left bracket link aperture defined therein, and (ii) the right bracket has a right rear implement aperture and a right bracket link aperture defined therein, and wherein the forward link aperture, the left bracket link aperture, and the right bracket link aperture are linearly aligned when the left rear coupler aperture, the right rear coupler aperture, the forward support aperture are linearly aligned with the left rear implement aperture and the right rear implement aperture.

In accordance with a second embodiment of the present invention, there is provided a work machine having a stick assembly which includes (i) a stick having a forward stick aperture (ii) a guide which is pivotally coupled to the stick, and (iii) a link pivotally coupled to the guide. The work machine also includes a coupler having a left lateral support and a right lateral support, wherein (i) the left lateral support has a left rear coupler aperture, a left intermediate coupler aperture, and a left forward coupler notch each being defined therein, and (ii) the right lateral support has a right rear coupler aperture, a right intermediate coupler aperture, and a right forward coupler notch each being defined therein. The work machine also includes an implement assembly having a left bracket and a right bracket, wherein (i) the left bracket has a left rear implement aperture, a left intermediate implement aperture, and a left forward implement aperture each being defined therein, and (ii) the right bracket has a right rear implement aperture, a right intermediate implement aperture, and a right forward implement aperture each being defined therein, and wherein the left intermediate coupler aperture, the right intermediate coupler aperture, the left intermediate implement aperture, and the right intermediate implement aperture are linearly aligned when (i) the left rear coupler aperture, the right rear coupler aperture, the forward stick aperture are linearly aligned with the left rear implement aperture and the right rear implement aperture, and (ii) the left forward coupler notch, the right forward coupler notch are linearly aligned with the left forward implement aperture and the right forward implement aperture.

In accordance with a third embodiment of the present invention, there is provided a work machine having a stick assembly which includes (i) a stick having a forward stick aperture (ii) a guide which is pivotally coupled to the stick, and (iii) a link pivotally coupled to the guide. The work machine also includes a coupler having a left lateral support and a right lateral support, wherein (i) the left lateral support has a left rear coupler aperture, a left intermediate coupler aperture, and a left forward coupler notch each being defined therein, and (ii) the right lateral support has a right rear aperture, a right intermediate coupler aperture, and a right forward coupler notch each being defined therein. The work machine further includes a bucket assembly having a left bracket and a right bracket, wherein (i) the left bracket has a left rear bucket aperture, a left intermediate bucket aperture, and a left forward bucket aperture each being defined therein, and (ii) the right bracket has a right rear bucket aperture, a right intermediate bucket aperture, and a right forward bucket aperture each being defined therein, wherein the left intermediate coupler aperture, the right intermediate coupler aperture, the left intermediate bucket aperture, and the right intermediate bucket aperture are linearly aligned when (i) the left rear coupler aperture, the right rear coupler aperture, the forward stick aperture are linearly aligned with the left rear bucket aperture and the right rear bucket aperture, and (ii) the left forward coupler notch, the right forward coupler notch are linearly aligned with the left forward bucket aperture and the right forward bucket aperture.

BEST MODE FOR CARRYING OUT THE INVENTION

Figure 1:
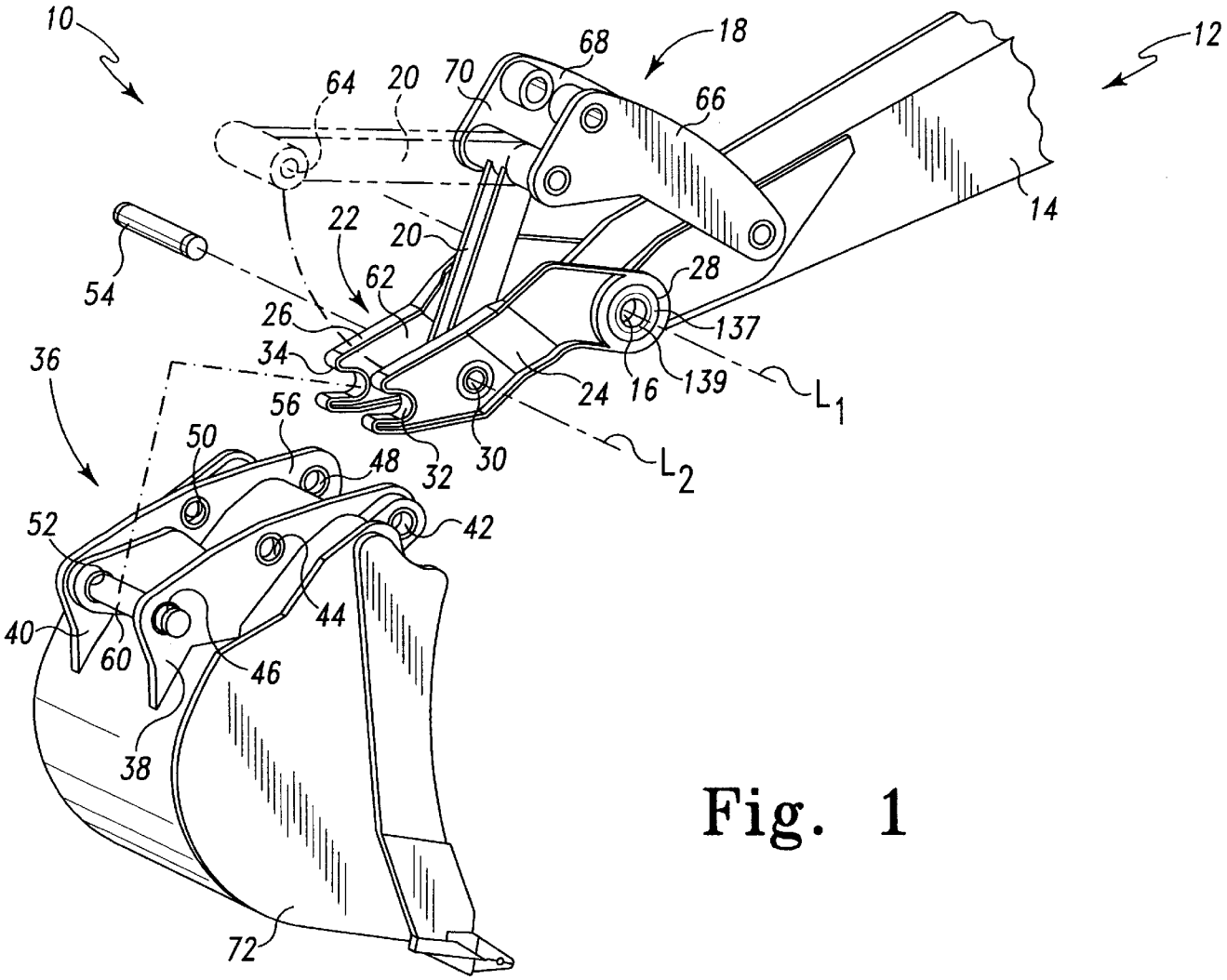
FIG. 1 is a fragmentary perspective view of a portion of a work machine which incorporates the features of the present invention therein, showing the implement assembly detached from the coupler and stick assembly.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 2:
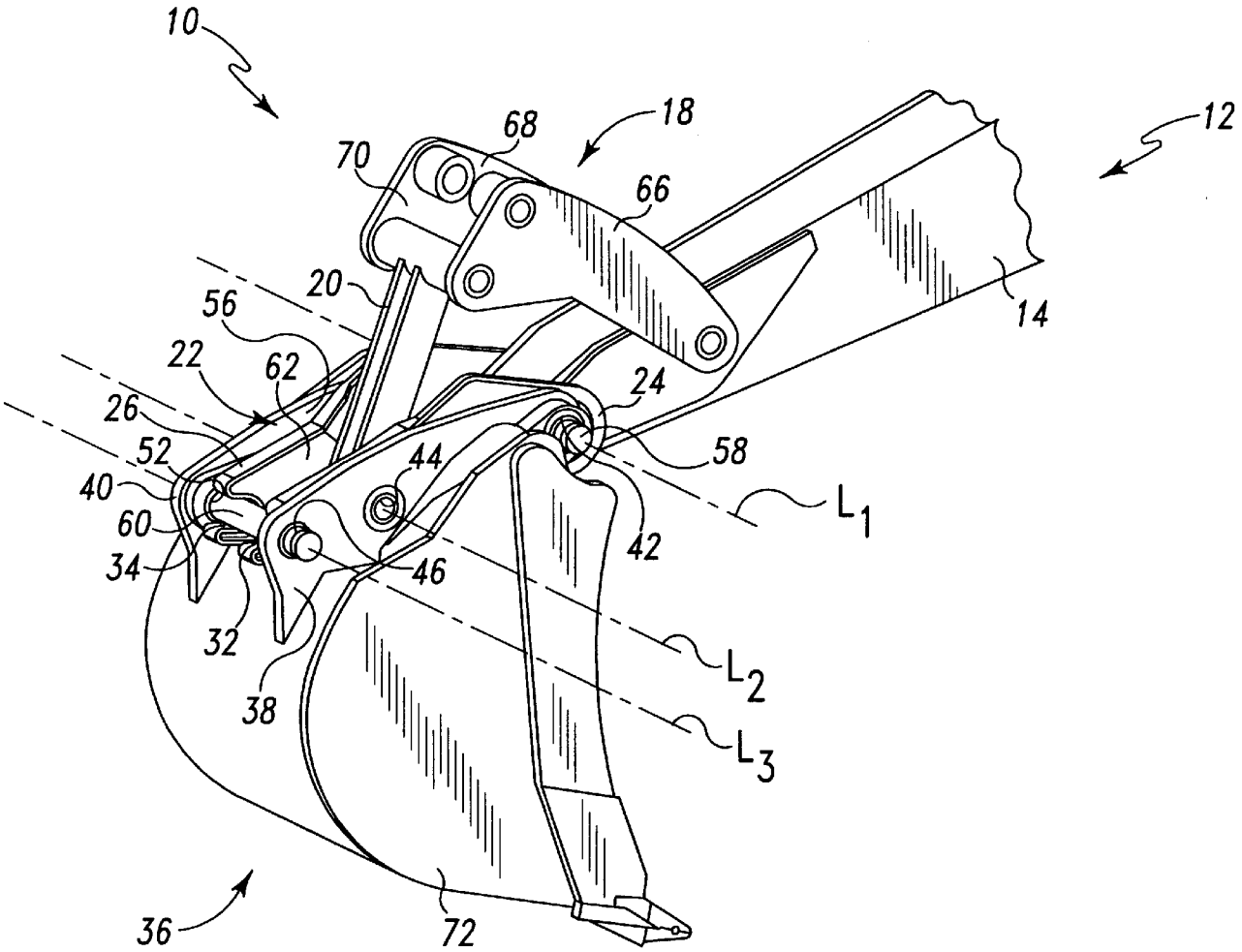
FIG. 2 is a view similar to FIG. 1, but showing the implement assembly attached to the coupler and stick assembly of the work machine.

Referring now to FIGS. 1 and 2, there is shown a portion of a work machine 10 which incorporates the features of the present invention therein. Work machine 10 includes a stick assembly 12, a coupler 22, and an implement assembly 36. Work machine 10 also includes a forward pin 60, an intermediate pin 54 (see FIG. 1), and a rear pin 58 (see FIG. 2).

Stick assembly 12 includes a stick 14. Stick 14 has a sleeve recess (not shown) defined in a unitary end (not shown) thereof. A stick sleeve 137 is positioned within the sleeve recess and secured to stick 14 (e.g. by welding) so as to define a forward stick aperture 16 in stick 14 (see FIG. 1). Note that a bearing member 139 is press fit into stick sleeve 137 so as to improve the wear characteristics of stick sleeve 137.

Stick assembly 12 also includes a guide 18 and a link 20. Guide 18 includes a left guide member 66 and a right guide member 68. Left guide member 66 and a right guide member 68 are spaced apart from each other so as to define a guide space 70 therebetween. Guide 18 is pivotally coupled to stick 14 with a pin such that stick 14 is positioned within guide space 70.

As shown in phantom in FIG. 1, link 20 has a forward link aperture 64 defined in an end thereof. Link 20 is pivotally coupled to guide 18 with a pin such that an end of link 20 is positioned within guide space 70.

Coupler 22 has a left lateral support 24 and a right lateral support 26. As shown in FIG. 1, left lateral support 24 has a left rear coupler aperture 28, a left intermediate coupler aperture 30, and a left forward coupler notch 32 defined therein. It should be understood that right lateral support 26 is substantially identical to left lateral support 24. Specifically, right lateral support 26 has a right rear coupler aperture (not shown), a right intermediate coupler aperture (not shown), and a right forward coupler notch 34 defined therein. Left lateral support 24 and right lateral support 26 are spaced apart from each other so as to define a coupler space 62 therebetween.

Coupler 22 is positioned relative to stick 14 such that stick 14 is positioned within coupler space 62. Coupler 22 is further positioned relative to stick 14 such that forward stick aperture 16 is linearly aligned with left rear coupler aperture 28 and right rear coupler aperture (not shown) as illustrated by $L_1$ (see FIG. 1). Moreover, coupler 22 is positioned relative to stick 14 such that stick sleeve 137 is positioned within left rear coupler aperture 28 and the right rear coupler aperture.

In addition, coupler 22 is positioned relative to link 20 such that link 20 is positioned within coupler space 62. Coupler 22 is further positioned relative to link 20 such that forward link aperture 64 is linearly aligned with left intermediate coupler aperture 30 and right intermediate coupler aperture (not shown) as illustrated by line $L_2$ (see FIG. 1). Once coupler 22 is positioned relative to link 20 in the above described manner, intermediate pin 54 (see FIG. 1) is positioned within the right intermediate coupler aperture, forward link aperture 64, and left intermediate coupler aperture 30 so as to pivotally couple link 20 to coupler 22.

Implement assembly 36 includes a bucket 72 having a left bracket 38 and a right bracket 40 extending therefrom. Left bracket 38 and right bracket 40 are spaced apart from each other so as to define a bracket space 56 therebetween. Left bracket 38 has a left rear implement aperture 42, a left intermediate implement aperture 44, and a left forward implement aperture 46 defined therein. As shown in FIG. 1, right bracket 40 also has a right rear implement aperture 48, a right intermediate implement aperture 50, and a right forward implement aperture 52 defined therein. Forward pin 60 is inserted through right forward implement aperture 52 and left forward implement aperture 46.

As shown in FIG. 2, implement assembly 36 is positioned relative to stick assembly 12 and coupler 22 such that stick 14 and coupler 22 are positioned within bracket space 56. Implement assembly 36 is further positioned relative to stick assembly 12 and coupler 22 such that (i) left intermediate coupler aperture 30, the right intermediate coupler aperture, left intermediate implement aperture 44, right intermediate implement aperture 50, forward link aperture 64, and intermediate pin 54 are all linearly aligned as illustrated by line $L_2$, (ii) left rear coupler aperture 28, the right rear coupler aperture, forward stick aperture 16, left rear implement aperture 42, and right rear implement aperture 48 are all linearly aligned as illustrated by line $L_1$, and (iii) left forward coupler notch 32, right forward coupler notch 34, left forward implement aperture 46, and right forward implement aperture 52 are all linearly aligned as illustrated by line $L_3$.

Once implement assembly 36 is positioned in the above described manner rear pin 58 is positioned within each of left rear coupler aperture 28, the right rear coupler aperture, forward stick aperture 16, left rear implement aperture 42, and right rear implement aperture 48 so as to pivotally couple implement assembly 36 to stick 14 as shown in FIG. 2. In addition, once implement assembly 36 is positioned in the above described manner it should be understood that (i) intermediate pin 54 is positioned within bracket space 56, but maintained spaced apart from both left intermediate implement aperture 44 and right intermediate implement aperture 50 and (ii) forward pin 60 is positioned within each of left forward coupler notch 32 and right forward coupler notch 34.

Figure 3:
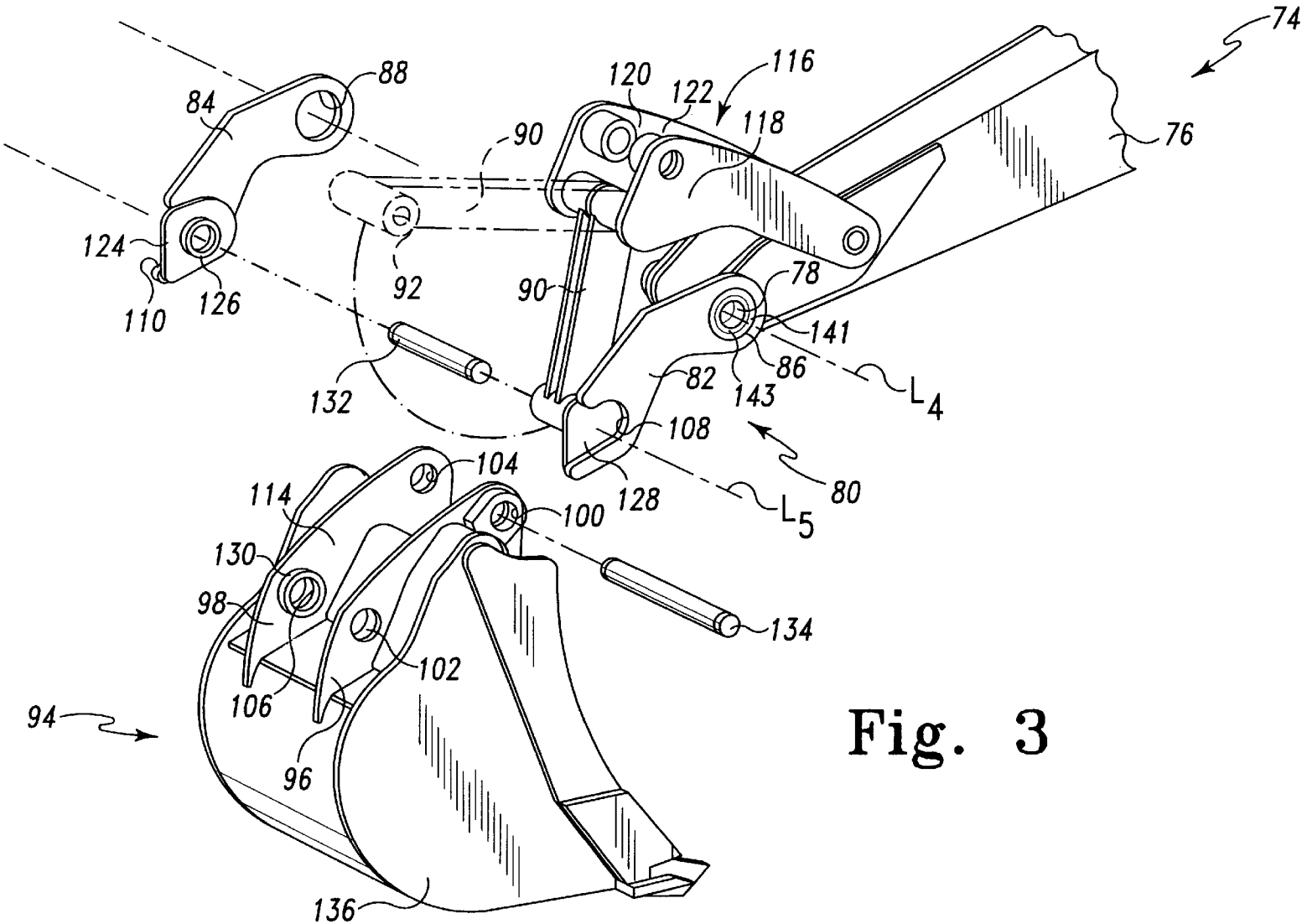
FIG. 3 is a fragmentary perspective exploded view of a portion of a work machine which incorporates a second embodiment of the present invention therein, showing the implement assembly detached from the coupler and stick assembly.
Figure 4:
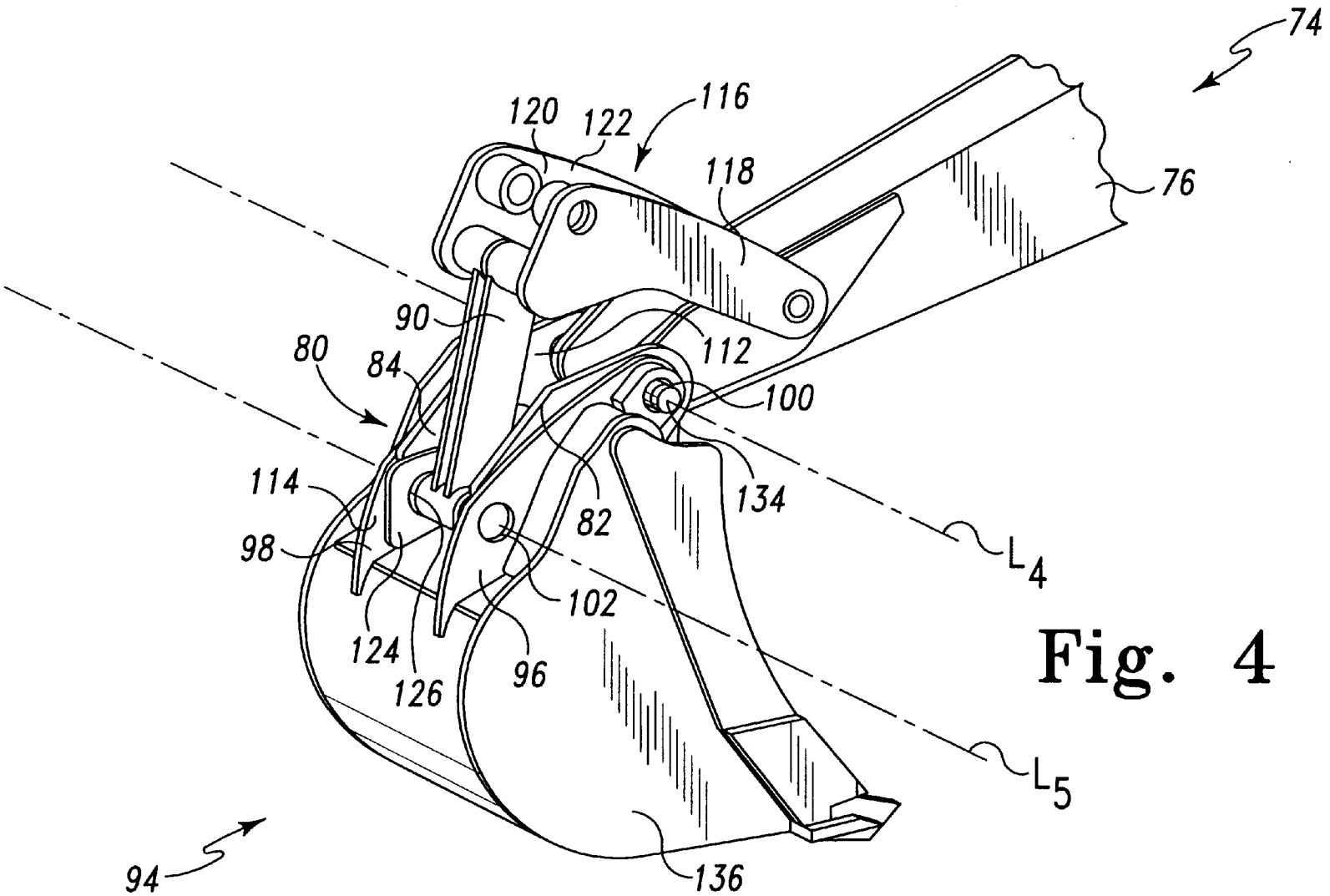
FIG. 4 is a view similar to FIG. 3, but showing the implement assembly attached to the coupler and stick assembly of the work machine.

Referring now to FIGS. 3 and 4, there is shown a portion of a work machine 74 which incorporates a second embodiment of the present invention therein. Work machine 74 includes (i) a support member 76 having a forward support aperture 78, (ii) a coupler 80, (iii) a link 90, and (iv) an implement assembly 94. Work machine 74 also includes a link pin 132 (see FIG. 3), a rear pin 134, and a guide 116.

Support member 76 has a support member recess (not shown) defined in a unitary end (not shown) thereof. A support member sleeve 141 is positioned within the support member recess and secured to support member 76 (e.g. by welding) so as to define forward support aperture 78. Note that a bearing member 143 is press fit into support member sleeve 141 so as to improve the wear characteristics of support member sleeve 141.

Guide 116 includes a left guide member 118 and a right guide member 120. Left guide member 118 and a right guide member 120 are spaced apart from each other so as to define a guide space 122 therebetween. Guide 116 is pivotally coupled to support member 76 with a pin such that support member 76 is positioned within guide space 122.

As shown in phantom in FIG. 3, link 90 has a forward link aperture 92 defined in an end thereof. Link 90 is pivotally coupled to guide 116 with a pin such that an end of link 90 is positioned within guide space 122.

Coupler 80 has a left lateral support 82 and a right lateral support 84. As shown in FIG. 3, right lateral support 84 has a right rear coupler aperture 88 and a right forward coupler notch 110 defined therein. Right lateral support 84 also has a plate 124 secured thereto (e.g. by welding) such that plate 124 is adjacent to right forward coupler notch 110. Plate 124 has a boss 126 attached thereto (e.g. by welding). It should be understood that left lateral support 82 is substantially identical to right lateral support 84. Specifically, left lateral support 82 has a left rear coupler aperture 86 and a left forward coupler notch 108 defined therein. Left lateral support 82 also has a plate 128 secured thereto (e.g. by welding) such that plate 128 is adjacent to left forward coupler notch 108. Plate 128 has a boss (not shown) attached thereto (e.g. by welding) which is substantially identical to boss 126. Left lateral support 82 and right lateral support 84 are spaced apart from each other so as to define a coupler space 112 (see FIG. 4) therebetween.

Coupler 80 is positioned relative to support member 76 such that support member 76 is positioned within coupler space 112. Coupler 80 is further positioned relative to support member 76 such that forward support aperture 78 is linearly aligned with left rear coupler aperture 86 and right rear coupler aperture 88 as illustrated by $L_4$ (see FIG. 4). Moreover, coupler 80 is positioned relative to support member 76 such that support member sleeve 141 is positioned within left rear coupler aperture 86 and right rear coupler aperture 88.

In addition, coupler 80 is positioned relative to link 90 such that link 90 is positioned within coupler space 112. Coupler 80 is further positioned relative to link 90 such that forward link aperture 92 is linearly aligned with boss 126 and the boss attached to plate 128 as illustrated by line $L_5$ (see FIG. 4). It should be understood that prior to aligning forward link aperture 92 in the above described manner, link pin 132 (see FIG. 3) is positioned within forward link aperture 92 such that link pin 132 is also linearly aligned with, and positioned in, boss 126 and the boss attached to plate 128 so as to pivotally couple link 90 to coupler 80. If necessary, each end of link pin 132 can be cross bolted to boss 126 and the boss attached to plate 128 so as to ensure that link 90 remains attached to coupler 80 during use of work machine 74.

Implement assembly 94 includes a bucket 136 having a left bracket 96 and a right bracket 98 extending therefrom. Left bracket 96 and right bracket 98 are spaced apart from each other so as to define a bracket space 114 therebetween. Left bracket 96 has a left rear implement aperture 100 and a left bracket link aperture 102 defined therein. As shown in FIG. 3, right bracket 98 also has a right rear implement aperture 104 and a right bracket link aperture 106 defined therein. Right bracket 98 also has a boss 130 attached thereto such that boss 130 is linearly aligned with right bracket link aperture 106. Left bracket 96 also has a boss (not shown) attached thereto which is substantially identical to boss 130. Moreover, the boss attached to left bracket 96 is linearly aligned with left bracket link aperture 102.

As shown in FIG. 4, implement assembly 94 is positioned relative to support member 76 and coupler 80 such that support member 76 and coupler 80 are positioned within bracket space 114. Implement assembly 94 is further positioned relative to support member 76 and coupler 80 such that (i) forward link aperture 92, left bracket link aperture 102, right bracket link aperture 106, link pin 132, boss 126, the boss attached to plate 128, boss 130, the boss attached to left bracket 96, left forward coupler notch 108, and right forward coupler notch 110 are all linearly aligned as illustrated by line $L_5$ in FIG. 4, and (ii) left rear coupler aperture 86, right rear coupler aperture 88, forward support aperture 78, left rear implement aperture 100, and right rear implement aperture 104 are all linearly aligned as illustrated by line $L_4$ in FIG. 4. It should be appreciated that positioning the aforementioned elements in the above described manner locates boss 130 and the boss attached to left bracket 96 in right forward coupler notch 110 and left forward coupler notch 108, respectively. Locating boss 130 and the boss attached to left bracket 96 in the above described manner couples implement assembly 94 to coupler 80.

Once implement assembly 94 is positioned in the above described manner rear pin 134 is positioned within each of left rear coupler aperture 86, right rear coupler aperture 88, forward support aperture 78, left rear implement aperture 100, and right rear implement aperture 104 so as to pivotally couple implement assembly 94 to support member 76 as shown in FIG. 4. In addition, once implement assembly 94 is positioned in the above described manner it should be understood that link pin 132 is positioned within bracket space 114, but maintained spaced apart from both left bracket link aperture 102 and right bracket link aperture 106.

INDUSTRIAL APPLICABILITY

In order to secure implement assembly 36 to stick assembly 12 during use of work machine 10 (see FIGS. 1 and 2), bucket 72 is placed on the ground with forward pin 60 already inserted into left forward implement aperture 46 and right forward implement aperture 52 (see FIG. 1). Stick 14 is then manipulated by an operator (not shown) of work machine 10 such that (i) coupler 22 and stick 14 are positioned within bracket space 56 and (ii) forward pin 60 is located within left forward coupler notch 32 and right forward coupler notch 34 as shown in FIG. 2. Stick 14 is further manipulated relative to implement assembly 36 such that left rear coupler aperture 28, the right rear coupler aperture, forward stick aperture 16, left rear implement aperture 42, and right rear implement aperture 48 are all linearly aligned as illustrated by line $L_1$ (see FIG. 2). Once implement assembly 36 is positioned in the above described manner, rear pin 58 is inserted through left rear coupler aperture 28, the right rear coupler aperture, forward stick aperture 16, left rear implement aperture 42, and right rear implement aperture 48 so as to pivotally couple implement assembly 36 to stick assembly 12. Note that rear pin 58 is already shown inserted in FIG. 2.

It should be understood that coupling implement assembly 36 to stick assembly 12 and coupler 22 in the above described manner linearly aligns left intermediate coupler aperture 30, the right intermediate coupler aperture, left intermediate implement aperture 44, right intermediate implement aperture 50, forward link aperture 64, and intermediate pin 54 as illustrated by line $L_2$.

It should also be understood that implement assembly 36 can be directly attached to stick assembly 12 without coupler 22. Specifically, once coupler 22 is removed, stick assembly 12 is positioned relative to implement assembly 36 such that (i) forward link aperture 64 (see FIG. 1) is linearly aligned with left intermediate implement aperture 44 and right intermediate implement aperture 50 and (ii) forward stick aperture 16 of stick 14 is aligned with left rear implement aperture 42 and right rear implement aperture 48. Once aligned in the above described manner, a pin (not shown) is inserted through forward link aperture 64 (see FIG. 1), left intermediate implement aperture 44, and right intermediate implement aperture 50. In addition, rear pin 58 is inserted through forward stick aperture 16, left rear implement aperture 42, and right rear implement aperture 48. The above described arrangement pivotally couples implement assembly 36 directly to stick assembly 12 so that work functions can be performed.

It should be appreciated that the spatial relationship between implement assembly 36 and stick assembly 12 determines the performance characteristics of implement assembly 36 (e.g. the degree of rotation of bucket 72 relative to stick 14). It should also be appreciated that the design of the present invention allows the spatial relationship between implement assembly 36 and stick assembly 12 to remain substantially constant regardless of whether coupler 22 is utilized to couple implement assembly 36 to stick assembly 12 or whether implement assembly 36 is coupled directly to stick assembly 14. Specifically, (i) forward link aperture 64 is always linearly aligned with left intermediate implement aperture 44 and right intermediate implement aperture 50 and (ii) forward stick aperture 16 of stick 14 is always linearly aligned with left rear implement aperture 42 and right rear implement aperture 48 regardless of whether coupler 22 is utilized.

Maintaining the above described spatial relationship is important since it results in implement assembly 36 having the most desirable performance characteristics. For example, when (i) forward link aperture 64 is linearly aligned with left intermediate implement aperture 44 and right intermediate implement aperture 50 and (ii) forward stick aperture 16 of stick 14 is linearly aligned with left rear implement aperture 42 and right rear implement aperture 48 the degree of rotation of bucket 72 relative to stick 14 is greatest. Therefore, since the present invention always maintains the above described spatial relationship regardless of whether coupler 22 is utilized to attach implement assembly 36 to stick assembly 12, the performance characteristics of implement assembly 36 remains maximized with or without the use of coupler 22.

This is in contrast to other coupler, implement assembly, and stick assembly designs which require the above discussed spatial relationship between these components to be altered when a coupler is used to attach the implement assembly to the stick assembly. For example, other designs require the implement assembly to be pinned to the stick at a first location (i.e. at forward stick aperture 16) when no coupler is utilized, and pinned to the stick at a second location when a coupler is utilized. The necessity of having two separate pining locations on the stick is undesirable since it increases the mechanical complexity of the stick. In addition, altering the spatial relationship between the stick and the implement assembly in the above described manner decreases the performance characteristics of the implement assembly. For example, pining the implement assembly at the second location when a coupler is utilized results in a decrease in the degree of rotation between the implement assembly and the stick. Decreasing the degree of rotation in the above described manner interferes with the performance of the work functions. In addition, pining the implement assembly at the second location when a coupler is utilized results in the implement assembly being rotated relative to the stick with less force. As previously discussed, the present invention addresses these problems by maintaining the most desirable spatial relationship between implement assembly 36 and stick assembly 12 when coupler 22 is utilized to attach these two assemblies.

With respect to the second embodiment of the present invention (see FIGS. 3 and 4), implement assembly 94 is secured to support member 76 in a manner similar to that described above in reference to implement assembly 36, with the exception that coupler 80 is positioned relative to implement assembly 94 such that boss 130 and the boss attached to left bracket 96 are respectively located within right forward coupler notch 110 and left forward coupler notch 108 rather than having forward pin 60 located in the forward coupler notches (i.e. left forward coupler notch 32 and right forward coupler notch 34) as shown in FIG. 2. In addition, it should be understood that the spatial arrangement between the previously discussed elements of work machine 74 has the same advantages as discussed in reference to the spatial arrangement of the elements of work machine 10. Therefore, it should be appreciated that the second embodiment of the present invention addresses the same problems associated with other coupler and implement assembly designs discussed above which require the spatial relationship between the implement assembly and the support member to be altered when a coupler is used to attach the implement assembly to the support member.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

What is claimed is:

1. A work machine, comprising:

a support member having a forward support aperture;

a coupler having a left lateral support and a right lateral support, wherein (i) said left lateral support has a left rear coupler aperture defined therein, and (ii) said right lateral support has a right rear coupler aperture defined therein;

a link pivotally coupled to said coupler, said link having a forward link aperture;

an implement assembly having a left bracket and a right bracket, wherein (i) said left bracket has a left rear implement aperture and a left bracket link aperture defined therein, and (ii) said right bracket has a right rear implement aperture and a right bracket link aperture defined therein, and a guide pivotally coupled to said support member, wherein (i) said forward link aperture, said left bracket link aperture, and said right bracket link aperture are linearly aligned when said left rear coupler aperture, said right rear coupler aperture, said forward support aperture are linearly aligned with said left rear implement aperture and said right rear implement aperture, (ii) said guide includes a left guide member and a right guide member which are (1) both pivotally coupled to said support member and (2) spaced apart from each other so as to define a guide space therebetween, (iii) said support member is positioned within said guide space, and (iv) said link is also positioned within said guide space.

2. The work machine of claim 1, wherein:

said left lateral support has a left forward coupler notch defined therein, said right lateral support has a right forward coupler notch defined therein, and said left forward coupler notch, said right forward coupler notch, said forward link aperture, said left bracket link aperture, and said right bracket link aperture are linearly aligned when said left rear coupler aperture, said right rear coupler aperture, said forward support aperture are linearly aligned with said left rear implement aperture and said right rear implement aperture.

3. The work machine of claim 1, wherein:

said left lateral support and said right lateral support are spaced apart from each other so as to define a coupler space therebetween, and said support member is positioned within said coupler space.

4. The work machine of claim 1, wherein:

said left lateral support and said right lateral support are spaced apart from each other so as to define a coupler space therebetween, and said link is positioned in said coupler space.

5. The work machine of claim 4, wherein:

said left bracket and said right bracket are spaced apart so as to define a bracket space therebetween, and said left lateral support and said right lateral support are each positioned in said bracket space.

6. A work machine, comprising:

a stick assembly which includes (i) a stick having a forward stick aperture (ii) a guide which has a left guide member and a right guide member which are both pivotally coupled to said stick and spaced apart from each other so as to define a guide space therebetween, and (iii) a link pivotally coupled to said guide;

a coupler having a left lateral support and a right lateral support, wherein (i) said left lateral support has a left rear coupler aperture, a left intermediate coupler aperture, and a left forward coupler notch each being defined therein, and (ii) said right lateral support has a right rear coupler aperture, a right intermediate coupler aperture, and a right forward coupler notch each being defined therein; and an implement assembly having a left bracket and a right bracket, wherein (i) said left bracket has a left rear implement aperture, a left intermediate implement aperture, and a left forward implement aperture each being defined therein, and (ii) said right bracket has a right rear implement aperture, a right intermediate implement aperture, and a right forward implement aperture each being defined therein, wherein said left intermediate coupler aperture, said right intermediate coupler aperture, said left intermediate implement aperture, and said right intermediate implement aperture are linearly aligned when (i) said left rear coupler aperture, said right rear coupler aperture, said forward stick aperture are linearly aligned with said left rear implement aperture and said right rear implement aperture, and (ii) said left forward coupler notch, said right forward coupler notch are linearly aligned with said left forward implement aperture and said right forward implement aperture.

7. The work machine of claim 6, further comprising an intermediate pin, wherein:

said intermediate pin is positioned within said left intermediate coupler aperture and said right intermediate coupler aperture, and said intermediate pin is further positioned within a bracket space defined between said left bracket and said right bracket but maintained spaced apart from both said left intermediate implement aperture and said right intermediate implement aperture.

8. The work machine of claim 7, further comprising a rear pin and a forward pin, wherein:

said rear pin is positioned within each of said left rear coupler aperture, said right rear coupler aperture, said forward stick aperture, said left rear implement aperture, and said right rear implement aperture, and said forward pin is positioned within each of said left forward coupler notch, said right forward coupler notch, said left forward implement aperture, and said right forward implement aperture.

9. The work machine of claim 6, wherein:

said left lateral support and said right lateral support are spaced apart from each other so as to define a coupler space therebetween, said link has a forward link aperture defined therein, and said link is positioned in said coupler space so that said forward link aperture is linearly aligned with said left intermediate coupler aperture and said right intermediate coupler aperture.

10. The work machine of claim 9, wherein:

said left bracket and said right bracket are spaced apart so as to define a bracket space therebetween, and said left lateral support and said right lateral support are each positioned in said bracket space.

11. The work machine of claim 6, wherein:

said stick is positioned within said guide space, and said link is also positioned within said guide space.

12. The work machine of claim 6, wherein:

said left lateral support and said right lateral support are spaced apart from each other so as to define a coupler space therebetween, and said link is positioned within both said guide space and said coupler space.

13. A work machine, comprising:

a stick assembly which includes (i) a stick having a forward stick aperture (ii) a guide which has a left guide member and a right guide member which are both pivotally coupled to said stick and spaced apart from each other so as to define a guide space therebetween, and (iii) a link pivotally coupled to said guide;

a coupler having a left lateral support and a right lateral support, wherein (i) said left lateral support has a left rear coupler aperture, a left intermediate coupler aperture, and a left forward coupler notch each being defined therein, and (ii) said right lateral support has a right rear aperture, a right intermediate coupler aperture, and a right forward coupler notch each being defined therein; and a bucket assembly having a left bracket and a right bracket, wherein (i) said left bracket has a left rear bucket aperture, a left intermediate bucket aperture, and a left forward bucket aperture each being defined therein, and (ii) said right bracket has a right rear bucket aperture, a right intermediate bucket aperture, and a right forward bucket aperture each being defined therein, wherein said left intermediate coupler aperture, said right intermediate coupler aperture, said left intermediate bucket aperture, and said right intermediate bucket aperture are linearly aligned when (i) said left rear coupler aperture, said right rear coupler aperture, said forward stick aperture are linearly aligned with said left rear bucket aperture and said right rear bucket aperture, and (ii) said left forward coupler notch, said right forward coupler notch are linearly aligned with said left forward bucket aperture and said right forward bucket aperture.

14. The work machine of claim 13, further comprising an intermediate pin, wherein:

said intermediate pin is positioned within said left intermediate coupler aperture and said right intermediate coupler aperture, and said intermediate pin is further positioned within a bracket space defined between said left bracket and said right bracket but maintained spaced apart from both said left intermediate bucket aperture and said right intermediate bucket aperture.

15. The work machine of claim 14, further comprising a rear pin and a forward pin, wherein:

said rear pin is positioned within each of said left rear coupler aperture, said right rear coupler aperture, said forward stick aperture, said left rear bucket aperture, and said right rear bucket aperture, and said forward pin is positioned within each of said left forward coupler notch, said right forward coupler notch, said left forward bucket aperture, and said right forward bucket aperture.

16. The work machine of claim 13, wherein:

said left lateral support and said right lateral support are spaced apart from each other so as to define a coupler space therebetween, said link has a forward link aperture defined therein, and said link is positioned in said coupler space so that said forward link aperture is linearly aligned with said left intermediate coupler aperture and said right intermediate coupler aperture.

17. The work machine of claim 16, wherein:

said left bracket and said right bracket are spaced apart so as to define a bracket space therebetween, and said left lateral support and said right lateral support are each positioned in said bracket space.

18. The work machine of claim 13, wherein:

said stick is positioned within said guide space, and said link is also positioned within said guide space.

19. The work machine of claim 13, wherein:

said left lateral support and said right lateral support are spaced apart from each other so as to define a coupler space therebetween, and said link is positioned within both said guide space and said coupler space.

* * * * *